US011578506B2

(12) United States Patent
Chen

(10) Patent No.: US 11,578,506 B2
(45) Date of Patent: Feb. 14, 2023

(54) TRANSMISSION STRUCTURE OF A ROTARY SHAFT OF AN ELECTRONIC LOCK

(71) Applicant: Jeff Chen, Chiayi (TW)

(72) Inventor: Jeff Chen, Chiayi (TW)

( * ) Notice: Subject to any disclaimer, the term of this patent is extended or adjusted under 35 U.S.C. 154(b) by 364 days.

(21) Appl. No.: 17/004,468

(22) Filed: Aug. 27, 2020

(65) Prior Publication Data

US 2022/0064993 A1 Mar. 3, 2022

(51) Int. Cl.

*E05B 47/00* (2006.01)
*E05B 17/22* (2006.01)
*E05B 47/02* (2006.01)

(52) U.S. Cl.

CPC ..... *E05B 47/0012* (2013.01); *E05B 17/22* (2013.01); *E05B 47/02* (2013.01); *E05B 2047/002* (2013.01); *E05B 2047/003* (2013.01); *E05B 2047/0017* (2013.01); *E05B 2047/0091* (2013.01); *E05Y 2201/42* (2013.01); *E05Y 2201/434* (2013.01); *E05Y 2201/702* (2013.01); *E05Y 2201/704* (2013.01); *E05Y 2201/706* (2013.01); *E05Y 2400/86* (2013.01)

(58) Field of Classification Search

CPC ..... E05B 2047/002; E05B 2047/0026; E05B 2047/003; E05B 2047/0031; E05B 2047/0091; E05B 2047/0017; E05B 17/0054; E05B 17/0058; E05B 17/044; E05B 17/045; E05B 17/046; E05B 47/0012; E05B 47/02; E05B 47/0657; E05B 47/0661; E05B 47/068; E05B 47/0692; E05B 17/22; Y10T 70/5416; Y10T 70/5496; Y10T 70/5673; Y10T 70/5677; Y10T 70/5872; Y10T 70/7107; Y10T 70/7113; Y10T 70/7119; Y10T 70/7124

USPC ..... 292/347, 279, 144

See application file for complete search history.

(56) References Cited

U.S. PATENT DOCUMENTS

2004/0177660 A1* 9/2004 Tsai ..... E05B 47/068 70/277
2013/0167671 A1* 7/2013 Huang ..... E05B 47/068 74/25

FOREIGN PATENT DOCUMENTS

DE 102014018834 A1 * 6/2016

* cited by examiner

*Primary Examiner* — Christine M Mills
*Assistant Examiner* — Peter H Watson
(74) *Attorney, Agent, or Firm* — Alan D. Kamrath; Karin L. Williams; Mayer & Williams PC

(57) ABSTRACT

A transmission structure of a rotary shaft of an electronic lock contains: a drive unit which includes a holding plate, a motor, a worm, and a driven wheel. The holding plate includes an externally threaded portion and a fixing orifice. The driven wheel includes an internally threaded orifice, two protrusions, two flat zones, two arcuate fringes, and a tooth section. The transmission unit includes a guide element, a movable element, a resilient element, a retainer, and an acting element. The guiding element has a central orifice, the movable element has a guiding orifice, and the acting element has a slidable post. The frame includes a defining orifice and is welded with the holding plate. The connection seat is received in the defining orifice and includes a retaining portion. After the connection seat is received in the defining orifice, the retaining portion is engaged with a fastening ring.

2 Claims, 7 Drawing Sheets

TRANSMISSION STRUCTURE OF A ROTARY SHAFT OF AN ELECTRONIC LOCK

BACKGROUND OF THE INVENTION

Field of the Invention

The present invention relates to a transmission structure of a rotary shaft of an electronic lock which is rotated in 90 degrees to unlock the electronic lock quickly.

Description of the Prior Art

A conventional electronic lock contains a rotatable knob including a grip portion, and the grip portion has a stem extending from an end thereof. The stem has a cross orifice defined on a distal end thereof so that the stem is rotatably inserted in the rotatable knob to unlock/lock a door. The electronic lock also contains a motor having a fixing portion connected with a drive wheel; a driven wheel having a central extension connected with the stem of the rotatable knob, a tooth face surrounding a peripheral side of the driven wheel and meshed with the driven wheel, and a protrusion extending from a bottom of the driven wheel and driven by the driven wheel to touch a first touch portion or a second touch portion leftward or rightward.

However, when the motor is switched to rotate in a clockwise direction or a counterclockwise direction, a key is rotated 360 degrees to unlock or unlock the conventional electronic lock troublesomely.

The present invention has arisen to mitigate and/or obviate the afore-described disadvantages.

SUMMARY OF THE INVENTION

The primary object of the present invention is to provide a transmission structure of a rotary shaft of an electronic lock which is capable of overcoming the shortcomings of the conventional electronic lock. For example, when the motor is switched to rotate in a clockwise direction or a counterclockwise direction, a key is rotated 360 degrees to unlock or unlock the conventional electronic lock troublesomely To provide above-mentioned objects, a transmission structure of a rotary shaft of an electronic lock provided by the present invention contains: a drive unit including a holding plate, a motor, a worm, and a driven wheel; a transmission unit including a guide element, a movable element, a resilient element, a retainer, and an acting element; a frame, and a connection seat.

Thereby, when the electronic lock drives the worm by using the motor to actuate the driven wheel, the two protrusions of the driven wheel force the two opposite extensions of the guide element by way of the two arcuate fringes to push the movable element, and the two opposite extensions of the guide element are located on the two flat zones of the driven wheel so that the movable element moves forward to press the resilient element, and the rotary shaft of the electronic lock is rotated in the 90 degrees to unlock the electronic lock quickly.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
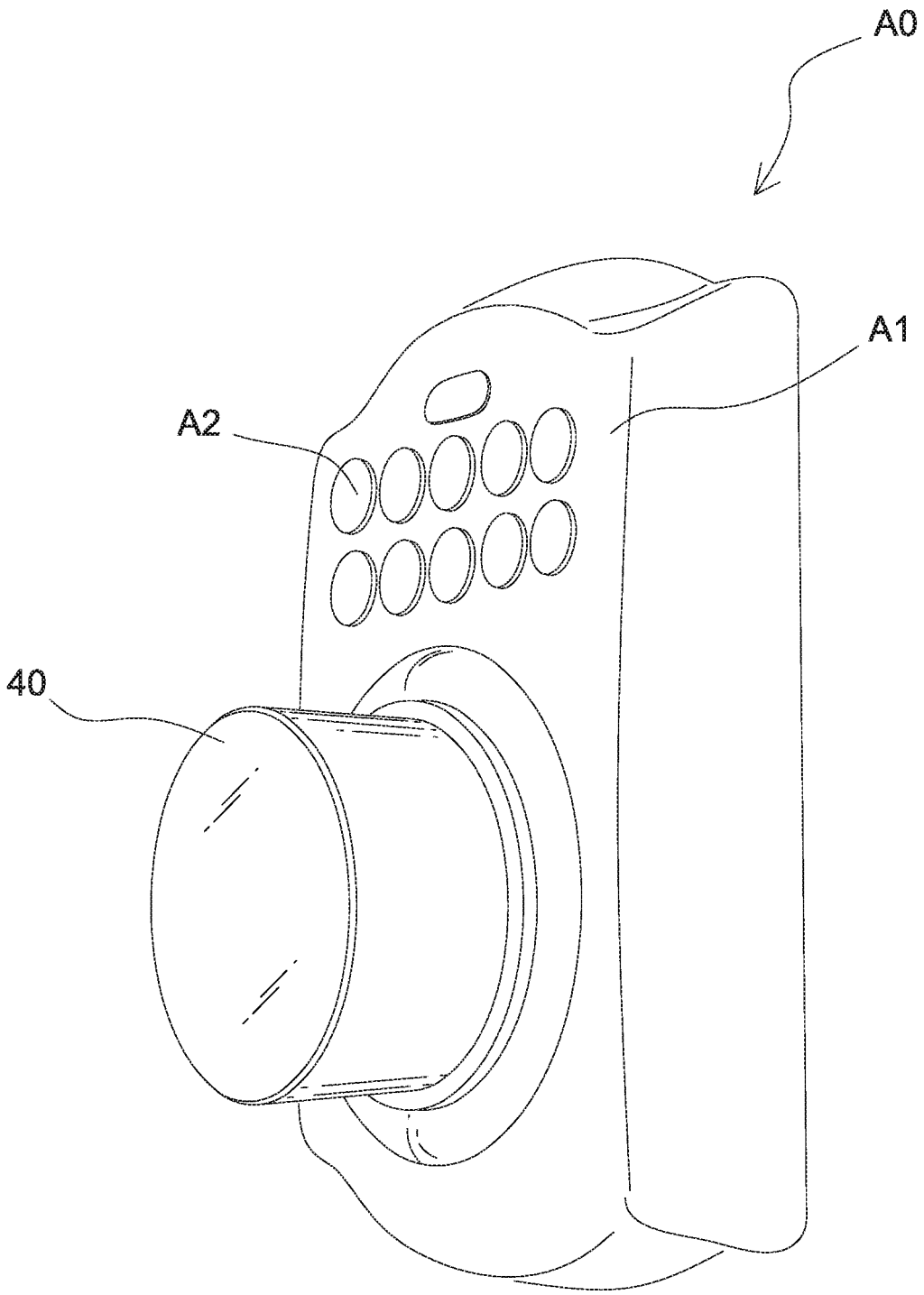
FIG. 1 is a perspective view showing the assembly of a transmission structure of a rotary shaft of an electronic lock according to a preferred embodiment of the present invention.
Figure 2:
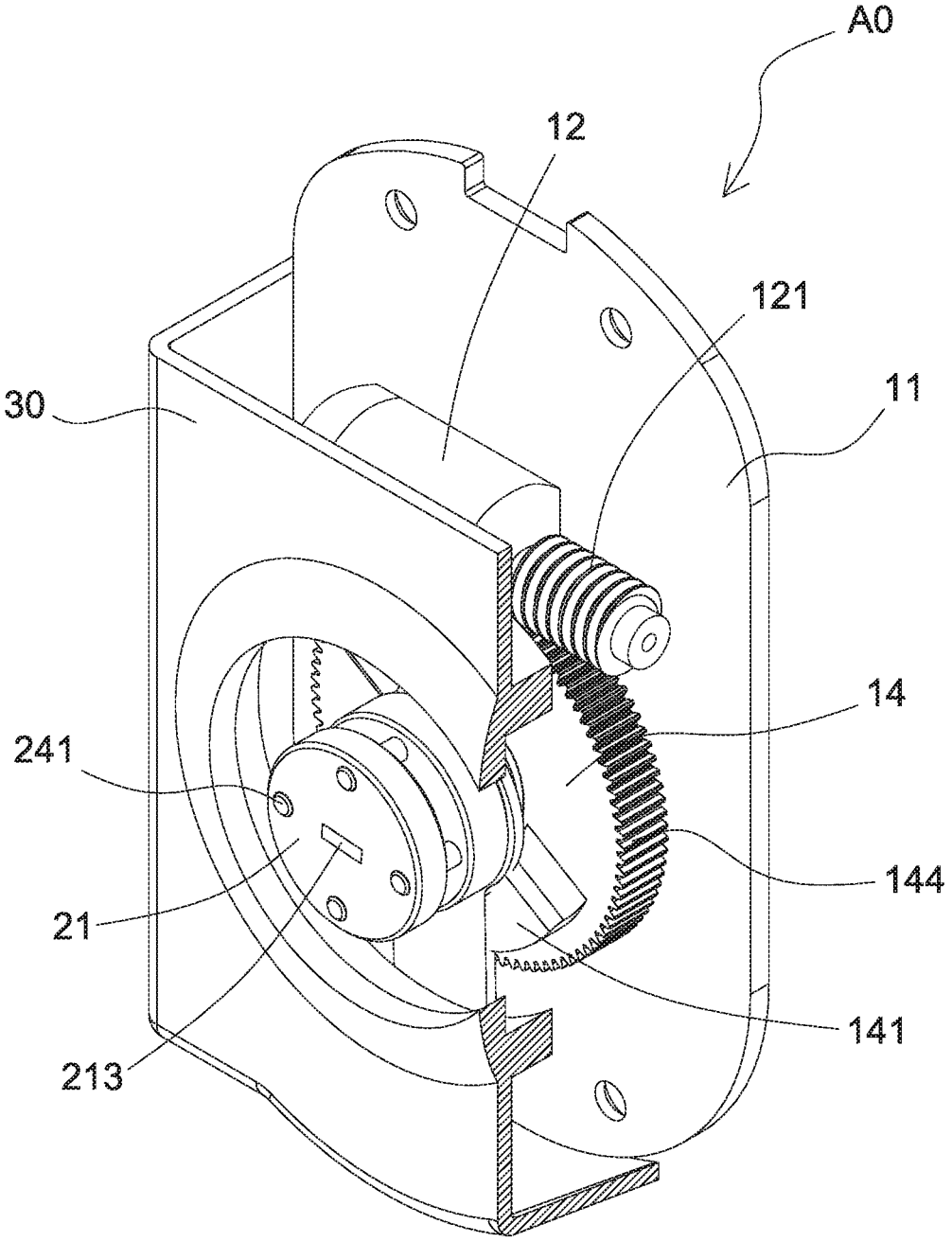
FIG. 2 is a cross-sectional perspective view showing the assembly of a part of the transmission structure of the rotary shaft of the electronic lock according to the preferred embodiment of the present invention.
Figure 3:
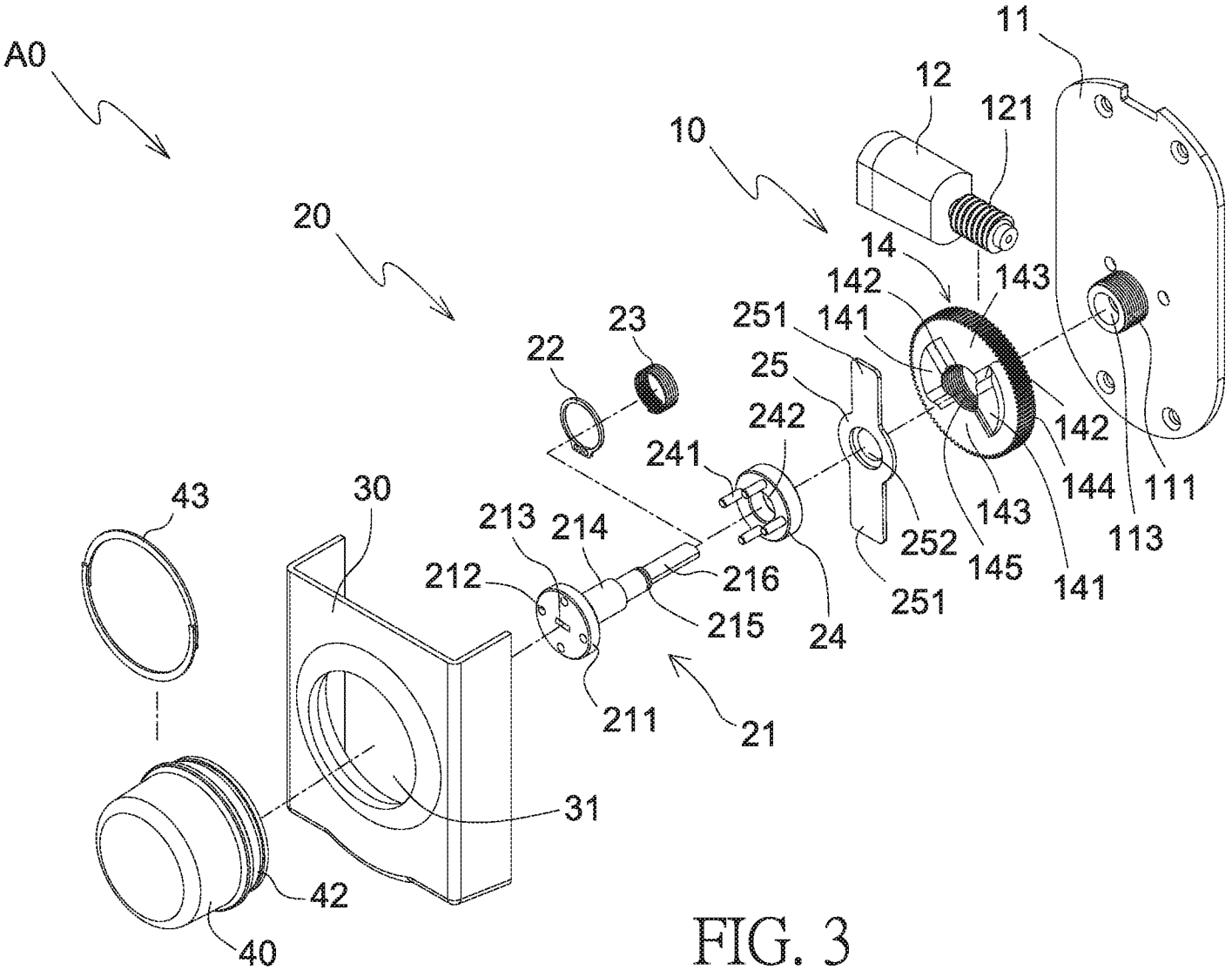
FIG. 3 is a perspective view showing the exploded components of the transmission structure of the rotary shaft of the electronic lock according to the preferred embodiment of the present invention.
Figure 4:
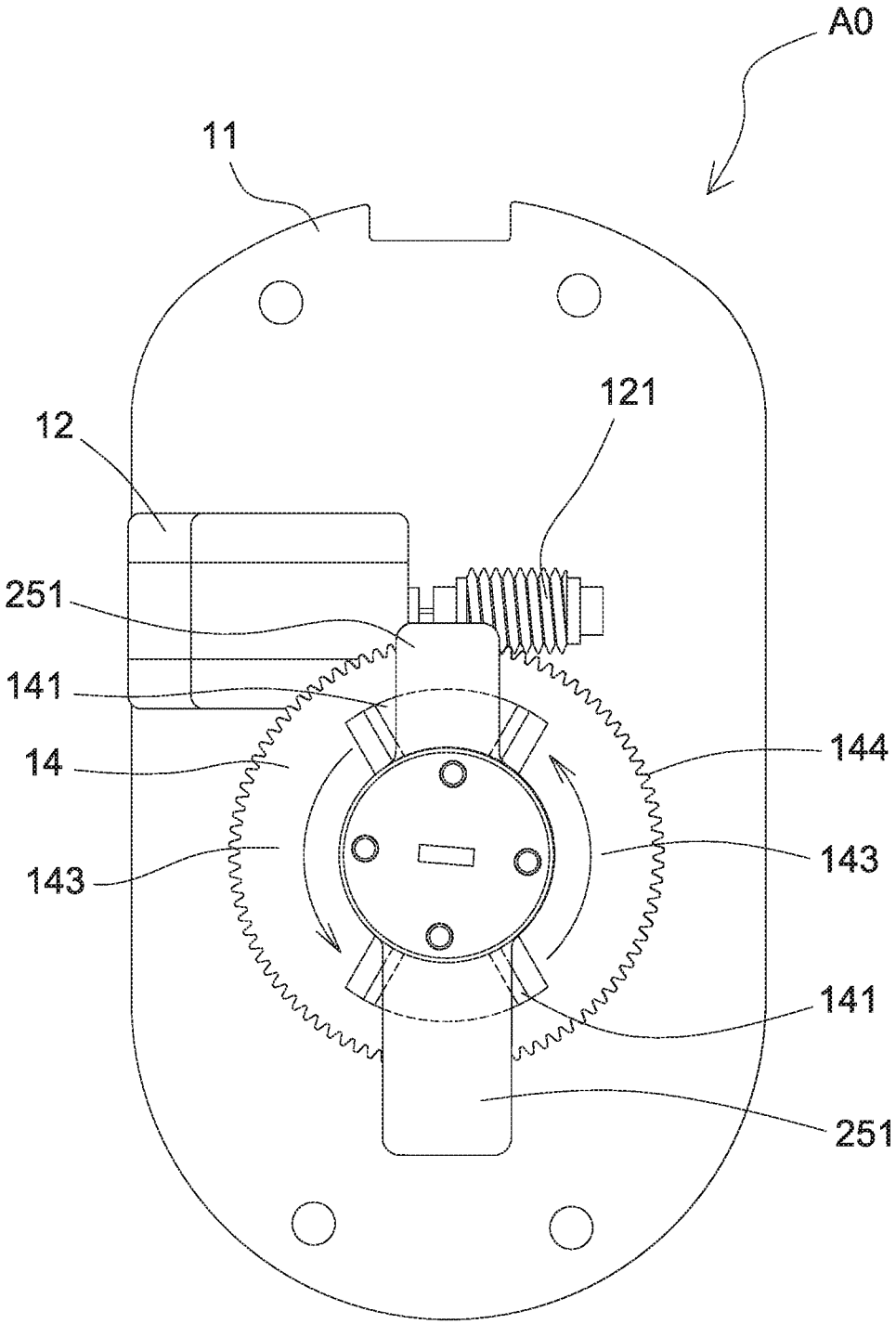
FIG. 4 is a side plan view showing the operation of the transmission structure of the rotary shaft of the electronic lock according to the preferred embodiment of the present invention.
Figure 5:
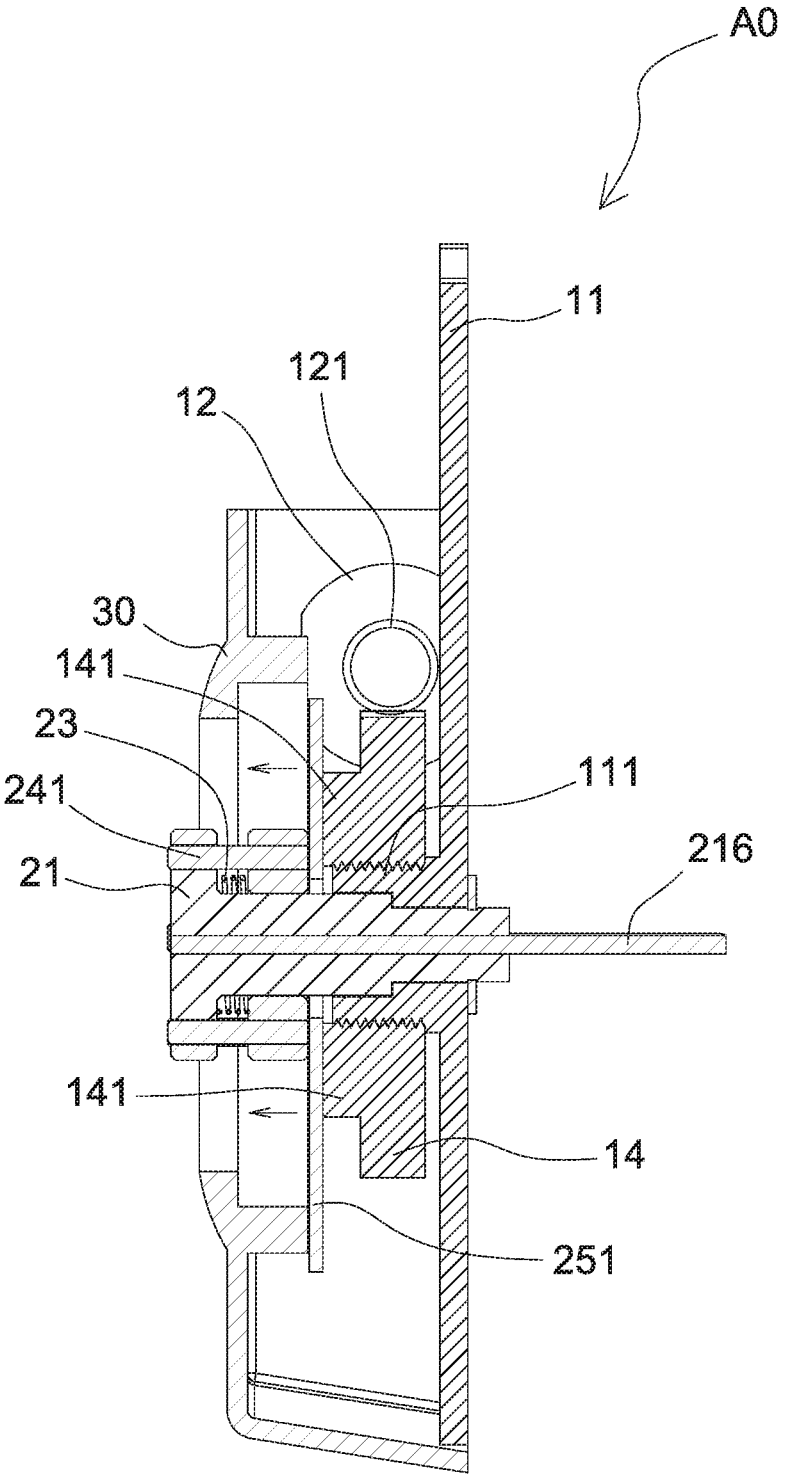
FIG. 5 is a cross sectional view showing the operation of the transmission structure of the rotary shaft of the electronic lock according to the preferred embodiment of the present invention.
Figure 6:
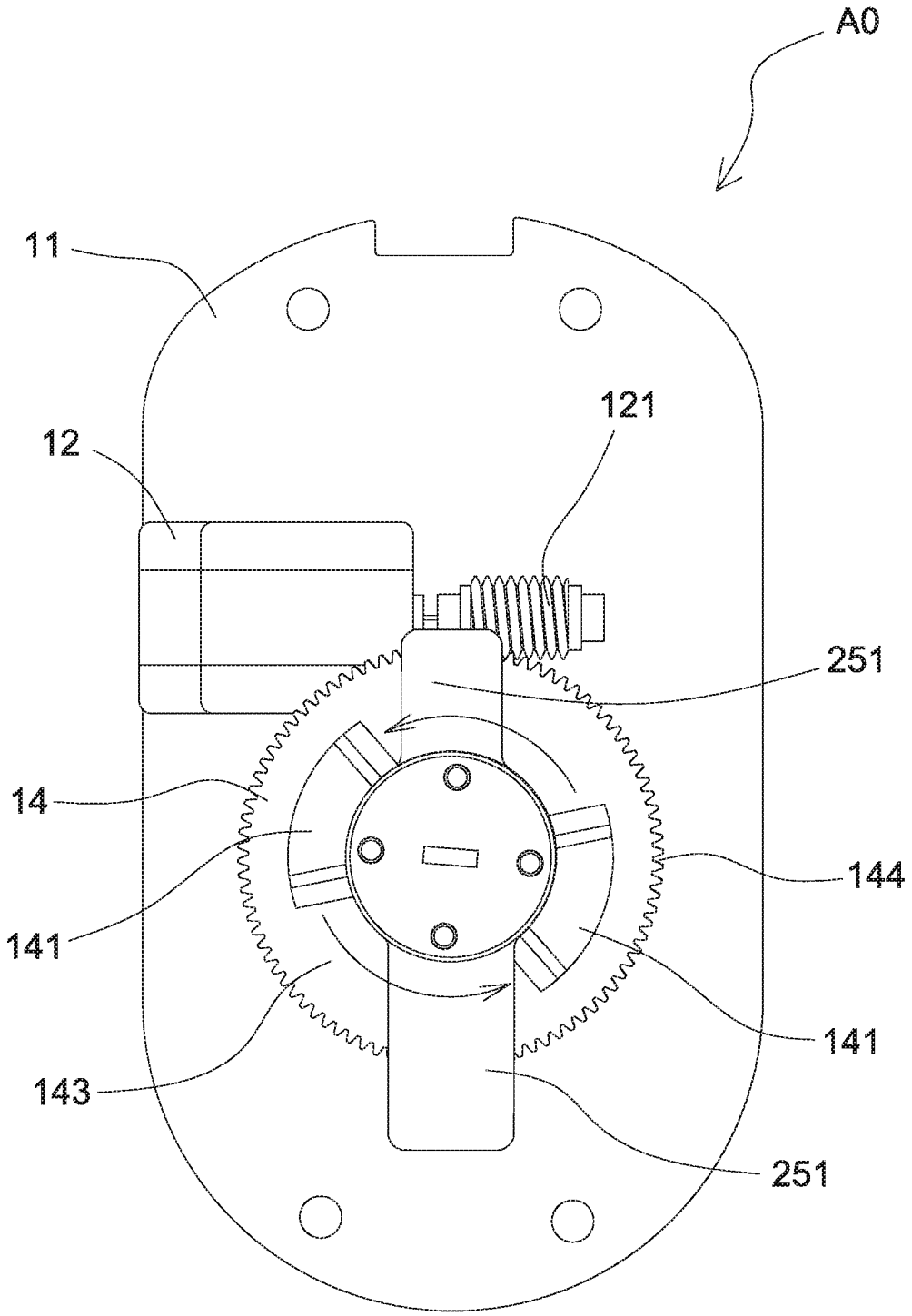
FIG. 6 is another side plan view showing the operation of the transmission structure of the rotary shaft of the electronic lock according to the preferred embodiment of the present invention.
Figure 7:
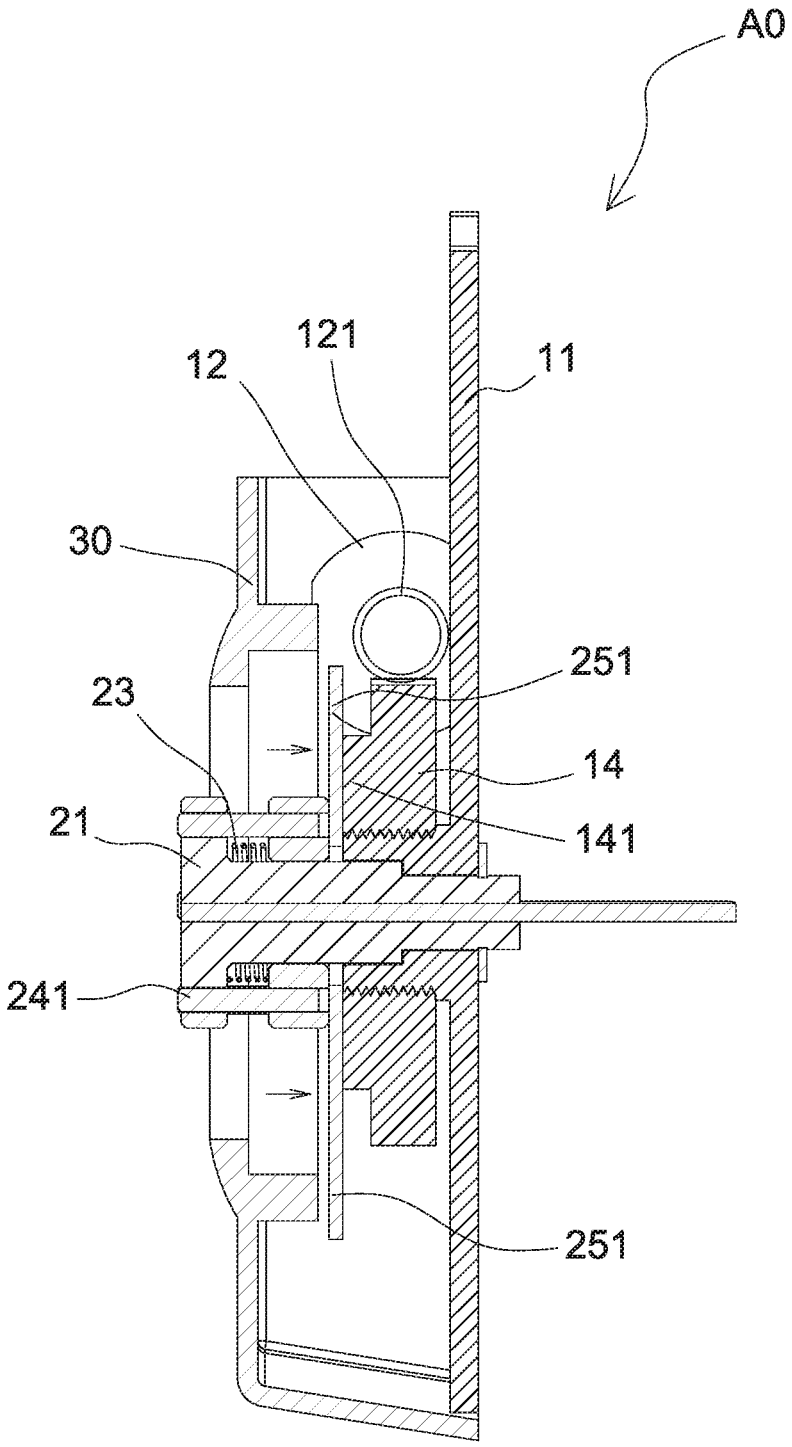
FIG. 7 is another cross sectional view showing the operation of the transmission structure of the rotary shaft of the electronic lock according to the preferred embodiment of the present invention.

With reference to FIGS. 1-7, a transmission structure of a rotary shaft of an electronic lock A0 according to a preferred embodiment of the present invention comprises: a drive unit 10 which is comprised of a holding plate 11, a motor 12, a worm 121, and a driven wheel 10; wherein the holding plate 11 includes an externally threaded portion 111 formed on a predetermined position thereof, and the holding plate 11 includes a fixing orifice 113 defined therein, the driven wheel 14 includes an internally threaded orifice 145 corresponding to and connected with the externally threaded portion 111 of the holding plate 11, two protrusions 141 extending from a surface of the driven wheel 14 and 90 degree is defined between the two protrusions 141, two flat zones 143 formed between the two protrusions 141, two arcuate fringes 142 formed on the two protrusions 141 opposite to the two flat zones 143, and a tooth section 144 formed on a peripheral side of the driven wheel 14 and meshing with the worm 121 which extends from an end of the motor 12, such that the motor 12 drives the worm 121 to urge the tooth section 144 of the driven wheel 12 to rotate;

a transmission unit 20 mounted on a surface of the drive unit 10, and the transmission unit 20 includes a guide element 25, a movable element 24, a resilient element 23, a retainer 22, and an acting element 21, wherein the guiding element 25 has a central orifice 252, the movable element 24 has a guiding orifice 242 corresponding to the central orifice 252, the acting element 21 has a slidable post 214 corresponding to the central orifice 252 and the guiding orifice 242, and the slidable post 214 has a stem 216 extending from an end thereof so that the slidable post 214 passes through the guiding orifice 242 of the movable element 24 and the central orifice 252 of the guide element 25, wherein the acting element 21 further has an engagement rib 215 formed on an end thereof, such that after the slidable post 214 of the acting element 21 is inserted into the fixing orifice 113 of the holding plate 11 via the central orifice 252 and the guiding orifice 242, the retainer 22 is engaged with the engagement rib 215 of the slidable post 214, and the guide element 25 and the movable element 24 are positioned in the slidable post 214 of the acting element 21, wherein the actuating element 21 has a driving segment 211 formed on an end thereof, a locking portion 213 defined on a center of a surface of the driving segment 211, and two opposite extensions 251 extending outward from an outer wall of the guide element 25, wherein the two extensions 251 are mounted on the two flat zones 143 of the driven wheel 14, and the movable element 24 has multiple columns 241 extending from a first end thereof and facing the actuating element 21, and the actuating element 21 has multiple receiving holes 212 defined on the driving segment 211 and corresponding to the multiple columns 241, such that the multiple columns 241 are slidably inserted into the multiple receiving holes 212, and the movable element 24 is fitted with the resilient element 23 relative to the driving segment 211, and a second end of the movable element 24 abuts against the guide element 25;

a frame 30 including a defining orifice 31 formed on a center thereof, and the frame 30 being welded with the holding plate 11, wherein the defining orifice 31 is aligned with the transmission unit 20;

a connection seat 40 being received in the defining orifice 31 of the frame 30 and including a retaining portion 42 extending from an end thereof, such that after the connection seat 40 is received in the defining orifice 31 of the frame 30, the retaining portion 42 of the locking seat 40 is engaged with a fastening ring 43.

Preferably, the frame 30 further includes a shell A1 formed on an outer wall thereof and a button unit A2 arranged on the shell A1.

When the electronic lock A0 drives the worm 121 by using the motor 12 to actuate the driven wheel 14, the two protrusions 141 of the driven wheel 14 force the two opposite extensions 251 of the guide element 25 by way of the two arcuate fringes 142 to push the movable element 24, and the two opposite extensions 251 of the guide element 25 are located on the two flat zones 143 of the driven wheel 14 so that the movable element 24 moves forward to press the resilient element 24, and the rotary shaft of the electronic lock is rotated in the 90 degrees to unlock the electronic lock quickly.

While various embodiments in accordance with the present invention have been shown and described, it is clear to those skilled in the art that further embodiments may be made without departing from the scope of the present invention.

What is claimed is:

1. A transmission structure of a rotary shaft of an electronic lock comprising: a drive unit which is comprised of a holding plate, a motor, a worm, and a driven wheel; wherein the holding plate including an externally threaded portion formed on a predetermined position thereof, and the holding plate includes a fixing orifice defined therein, the driven wheel includes an internally threaded orifice corresponding to and connected with the externally threaded portion of the holding plate, two protrusions extending from a surface of the driven wheel and a 90 degree angle is defined between the two protrusions, two flat zones formed between the two protrusions, two arcuate fringes formed on the two protrusions opposite to the two flat zones, and a tooth section formed on a peripheral side of the driven wheel and meshing with the worm which extends from an end of the motor, such that the motor drives the worm to urge the tooth section of the driven wheel to rotate;

a transmission unit mounted on a surface of the drive unit, and the transmission unit includes a guide element, a movable element, a resilient element, a retainer, and an acting element, wherein the guiding element has a central orifice, the movable element has a guiding orifice corresponding to the central orifice, the acting element has a slidable post corresponding to the central orifice and the guiding orifice, such that the slidable post passes through the guiding orifice of the movable element and the central orifice of the guide element, wherein the acting element further has an engagement rib formed on an end thereof, such that after the slidable post of the acting element is inserted into the fixing orifice of the holding plate via the central orifice and the guiding orifice, the retainer is engaged with the engagement rib of the slidable post, and the guide element and the movable element are positioned in the slidable post of the acting element, wherein the actuating element has a driving segment formed on an end thereof, a locking portion defined on a center of a surface of the driving segment, and two opposite extensions extending outward from an outer wall of the guide element, wherein the two extensions are mounted on the two flat zones of the driven wheel, and the movable element has multiple columns extending from a first end thereof and facing the actuating element, and the actuating element has multiple receiving holes defined on the driving segment and corresponding to the multiple columns, such that the multiple columns are slidably inserted into the multiple receiving holes, and the movable element is fitted with the resilient element relative to the driving segment, and a second end of the movable element abuts against the guide element;

a frame including a defining orifice formed on a center thereof, and the frame being welded with the holding plate, wherein the defining orifice is aligned with the transmission unit; and a connection seat being received in the defining orifice of the frame and including a retaining portion extending from an end thereof, such that after the connection seat is received in the defining orifice of the frame, the retaining portion of the locking seat is engaged with a fastening ring.

2. The transmission structure of the rotary shaft of the electronic lock as claimed in claim 1, wherein the frame further includes a shell formed on an outer wall thereof and a button unit arranged on the shell.

* * * * *